US007324046B1

(12) United States Patent
Wu

(10) Patent No.: US 7,324,046 B1
(45) Date of Patent: Jan. 29, 2008

(54) ELECTRONIC BEAM STEERING FOR KEYHOLE AVOIDANCE

(75) Inventor: Yeong-wei Andy Wu, Rancho Palos Verdes, CA (US)

(73) Assignee: The Boeing Company, Chicago, IL (US)

( * ) Notice: Subject to any disclaimer, the term of this patent is extended or adjusted under 35 U.S.C. 154(b) by 307 days.

(21) Appl. No.: 11/090,410

(22) Filed: Mar. 25, 2005

(51) Int. Cl.
*H01Q 3/00* (2006.01)

(52) U.S. Cl. ..... 342/359; 342/74; 342/75; 343/757

(58) Field of Classification Search ..... 342/74–76, 342/81, 154, 359; 343/754, 757
See application file for complete search history.

(56) References Cited

U.S. PATENT DOCUMENTS 4,280,127 A * 7/1981 Lee et al. ..... 342/25 A
4,823,134 A * 4/1989 James et al. ..... 342/359
5,202,695 A * 4/1993 Hollandsworth et al. ... 342/359
5,517,204 A * 5/1996 Murakoshi et al. ..... 343/765
5,594,460 A * 1/1997 Eguchi ..... 343/765
6,243,046 B1 * 6/2001 Aoki ..... 343/765
6,285,338 B1 * 9/2001 Bai et al. ..... 343/882
6,307,523 B1 * 10/2001 Green et al. ..... 343/781 CA
7,095,376 B1 * 8/2006 Timothy et al. ..... 343/705

* cited by examiner

*Primary Examiner*—Dao Phan
(74) *Attorney, Agent, or Firm*—Ingrassia Fisher & Lorenz, P.C.

(57) ABSTRACT

An airborne radio frequency (RF) antenna terminal system includes a two-axis gimbals control system and a phased array antenna. The phased array antenna electronically steers the receive and transmit beams using phase shifters. The electronically steered beams provide a virtual third-axis for the two-axis gimbals control system. The combination of the electronically steered beams and the two-axis gimbaled system provides accurate beam steering for the keyhole region of the two-axis gimbals control system so that the RF communication link is prevented from being lost in the keyhole region.

14 Claims, 5 Drawing Sheets

ELECTRONIC BEAM STEERING FOR KEYHOLE AVOIDANCE

GOVERNMENT RIGHTS

This invention was made with Government support under Contract Number: F19628-02-C-0048. The government has certain rights in this invention.

BACKGROUND OF THE INVENTION

The present invention generally relates to accurate beam pointing in the keyhole region of an airborne radio frequency (RF) antenna and, more particularly, to using phased array beam steering for third-axis motion in a two-axis gimbaled antenna control system.

Airborne radio frequency (RF) antenna terminal systems have been developed for the FAB-T (Family of Advanced Beyond line-of-sight Terminal) program for military EHF (Extremely High Frequency) satellite communication systems. Such RF antenna terminal systems may, for example, be mounted on a moving platform—such as a B-52 aircraft—and are designed to acquire and track a geostationary satellite payload or a polar satellite payload to establish a two-way digital beyond line-of-sight communication service that is secure, jam-resistant, scintillation-resistant (scintillation loss results from rapid variations in a communication signal's amplitude and phase due to changes in the refractive index of the Earth's atmosphere), and has a low probability of intercept and detection.

In order to meet the required communication link performance for such a communication service, the antenna pointing for tracking the satellite payload is required to be precisely controlled in the presence of platform motion. For example, the total signal loss due to antenna pointing error is typically required to be less than 1 decibel (dB), at the 3 sigma (standard deviation) level specified over a field-of-regard (FOR) given by 0 to 360 degrees in azimuth and 5 to 90 degrees in elevation.

One prior art RF antenna designed for existing EHF communication terminals used a two-axis gimbaled control system, which could not maintain the required pointing accuracy in the vicinity of the keyhole region—the region where the antenna pointing elevation angle is close to 90 degrees. Thus, in the keyhole region, the communication link could be temporarily lost due to pointing error using the two-axis gimbaled control system. A three-axis gimbaled control system was proposed and designed during the early phase of the FAB-T program to eliminate this keyhole problem. Because of the available antenna dome volume, however, the three-axis gimbaled control system could not accommodate the required antenna aperture to meet the desired antenna gain performance.

As can be seen, there is a need for accurate antenna pointing in the keyhole region from a moving platform. Moreover, there is a need for accurately pointing an antenna in the keyhole region of a moving platform that does not require a larger antenna dome, or a smaller antenna aperture.

SUMMARY OF THE INVENTION

In one aspect of the present invention, a communication system includes a two-axis gimbals control system having a gimbals azimuth axis and a gimbals elevation axis; and an antenna mounted to the two-axis gimbals control system along the elevation axis. The antenna generates an electronically steered beam that adjusts the antenna pointing direction relative to a cross-elevation axis that is perpendicular to the gimbals elevation axis.

In another aspect of the present invention, a method for antenna pointing includes steps of: controlling antenna pointing using a two-axis gimbals control system when an antenna LOS pointing vector is outside a keyhole region; and controlling antenna pointing using the two-axis gimbals control system with additional electronic beam steering using electronically steered angles when the antenna LOS pointing vector is inside the keyhole region.

In a further aspect of the present invention, a method for communication system antenna pointing from a moving platform includes steps of: commanding an azimuth angle and an elevation angle to a two-axis gimbals control system having a gimbals azimuth axis and a gimbals elevation axis. The two-axis gimbals control system is located on the moving platform. The method also includes steps of: computing a cross-azimuth angle and cross-elevation angle for an antenna mounted to the two-axis gimbals control system along the elevation axis; and adjusting the antenna pointing direction electronically relative to a cross-elevation axis that is perpendicular to the gimbals elevation axis, using the cross-azimuth angle and cross-elevation angle.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention uses the electronically steered beams generated by a phased array antenna to add a third-axis motion for a two-axis gimbaled control system for antenna beam pointing from a moving platform for radio-frequency (RF) communication systems. For example, one embodiment is especially useful for antenna beam pointing in a beyond line-of-sight communications link between an aircraft and a satellite and provides reliable antenna pointing and signal strength in the keyhole region of the aircraft. One embodiment thus differs from prior art two-axis gimbals control systems—which do not provide reliable antenna pointing in the keyhole region—by effectively providing a three-axis gimbals control that provides reliable antenna pointing in the keyhole region. One embodiment differs from prior art three-axis gimbals control systems, which rely on a third mechanical gimbal to provide three-axis gimbals control, by using electronic steering of the beam to achieve the third axis control and providing an antenna having a larger aperture than can be provided in a mechanical three-axis gimbals system having the same volume. One embodiment thus maximizes the antenna gain performance while solving the keyhole problem.

For example, because the FAB-T (Family of Advanced Beyond line-of-sight Terminal) antenna is a phased array antenna, which has the capability to electronically steer the received and transmitted beams using phase shifters, one embodiment can make use of electronically steered beams to accommodate the third-axis gimbaled motion. Using the two-axis gimbaled system with the aid of electronically steered beams, one embodiment can annihilate the keyhole region while optimizing RF performance. As pointed out in the case of a prior art three-axis gimbals system, the size of the antenna aperture needs to be reduced to satisfy the same volume constraints because of additional volume needed for the cross-elevation (third) gimbals axis. The three-axis gimbals approach not only degrades the antenna gain, it also increases the system weight and power. Since the FAB-T antenna is a phased array antenna, it can steer its received and transmitted beams away from its boresight using the available phase shifters (5-bit phase shifters). Hence, one embodiment can use a two-axis gimbaled system and electronically steer the beams off to compensate for the pointing error when the line of sight (LOS) enters the keyhole region.

Figure 1:
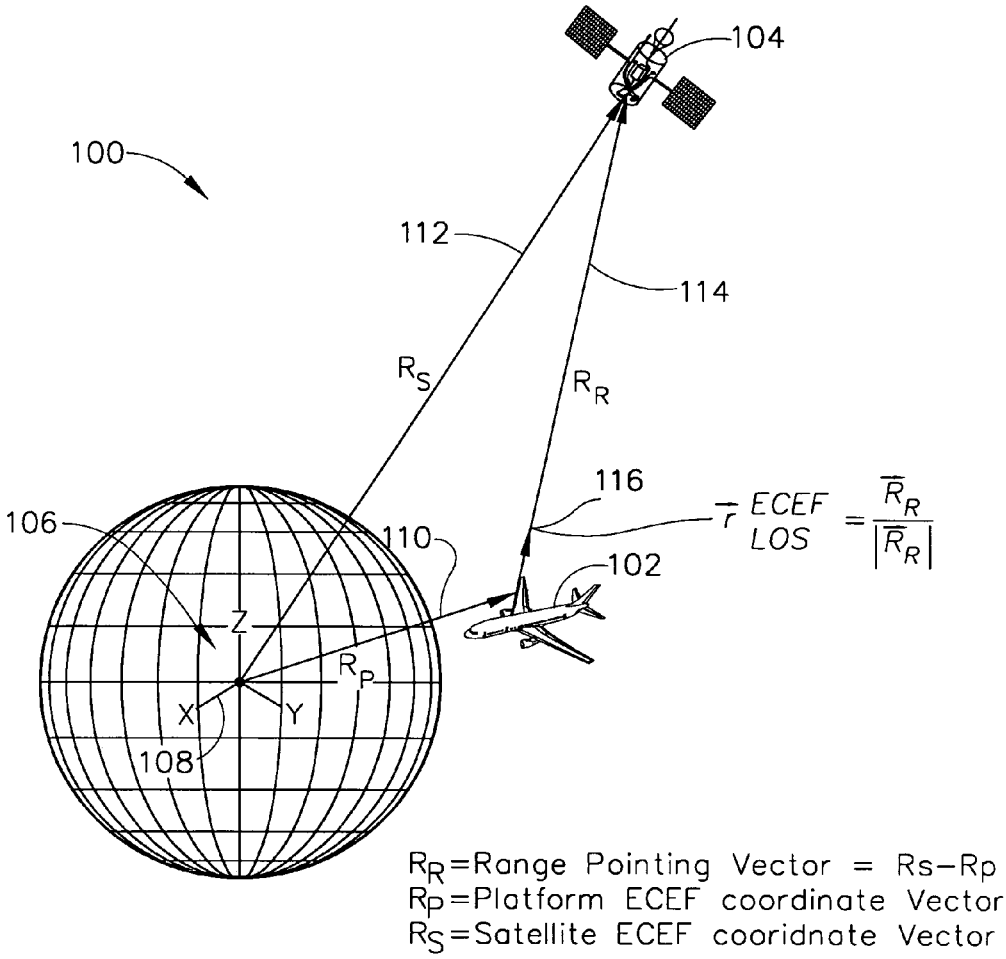
FIG. 1 is a geometrical diagram for a satellite communication system in accordance with an embodiment of the present invention.

Referring now to the figures, FIG. 1 shows a communication system 100 in accordance with an embodiment of the present invention. Communication system 100 may include a beyond line-of-sight communications link (not shown) between a moving platform 102—e.g., an aircraft—and a satellite 104. Communication system 100 may refer to an Earth-centered Earth-fixed (ECEF) reference frame 106. For example, ECEF reference frame 106 may have coordinate axes 108 originating at the planet Earth's center of mass and rotating with the Earth. ECEF reference frame 106 may be contrasted, for example, to an Earth-centered inertial (ECI) reference frame (not shown) having coordinate axes originating at the planet's center of mass and pointing toward fixed stars. A platform ECEF coordinate vector $R_P$ 110 may represent the position of platform 102 relative to ECEF reference frame 106. Likewise, a satellite ECEF coordinate vector $R_S$ 112 may represent the position of satellite 104 relative to ECEF reference frame 106.

A range pointing vector $R_R$ 114 may represent the position of satellite 104 relative to platform 102 and may also be described as a vector from the platform 102 to the satellite 104 (e.g., a vector in the direction of the line-of-sight (LOS) from the platform 102 to the satellite 104). Range pointing vector $R_R$ 114 may be computed in the ECEF coordinate frame 106 by vector subtraction of vector $R_P$ 110 from vector $R_S$ 112, i.e., $R_R=R_S-R_P$. As well known, a unit vector (vector having a length of one) in the direction of vector $R_R$ 114 may be computed by scalar division of vector $R_R$ 114 by its length $|R_R|$ to provide a normalized (i.e., unit length) range pointing vector $\vec{r}_{LOS}^{ECEF}$ 116 with respect to the ECEF reference frame 106, i.e., $$\vec{r}_{LOS}^{ECEF} = \frac{R_R}{|R_R|}. \tag{1}$$

Thus, normalized range pointing vector $\vec{r}_{LOS}^{ECEF}$ 116 may be described as a unit vector in the direction of the line-of-sight from the platform 102 to the satellite 104 relative to the ECEF reference frame 106.

Figure 2:
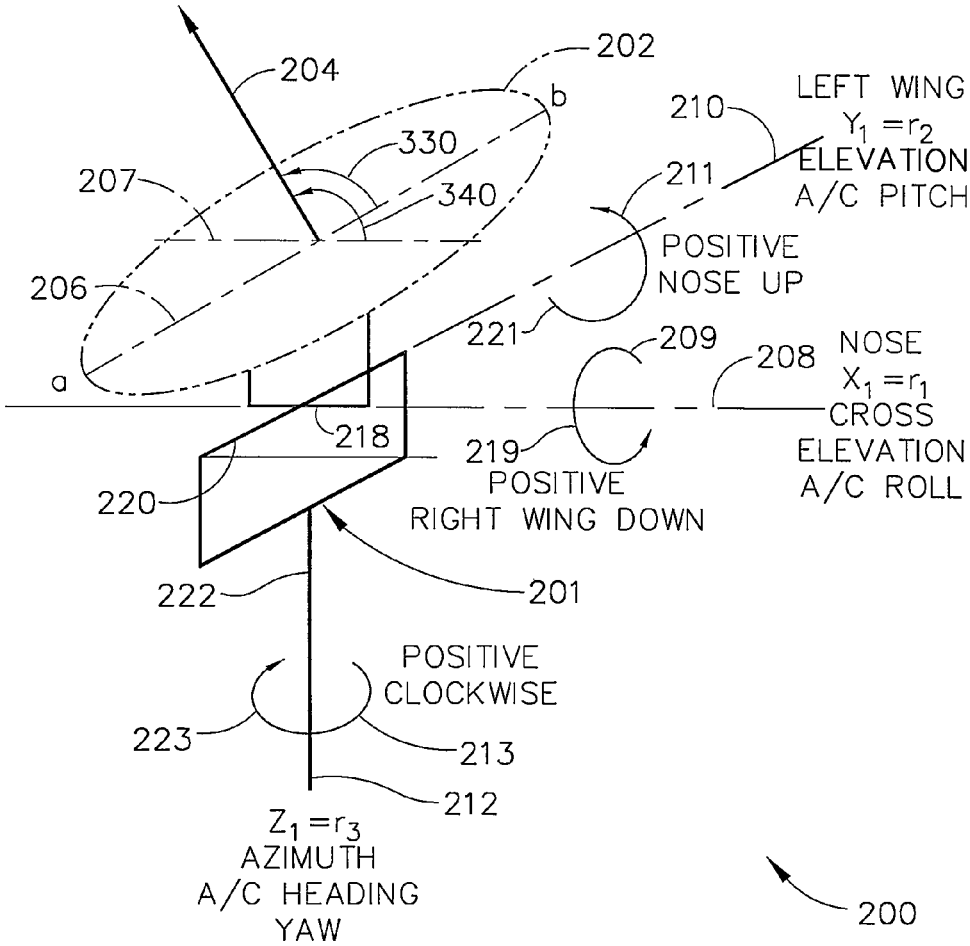
FIG. 2 is a schematic diagram for antenna pointing axes on an antenna platform for a satellite communication system in accordance with an embodiment of the present invention.
Figure 3:
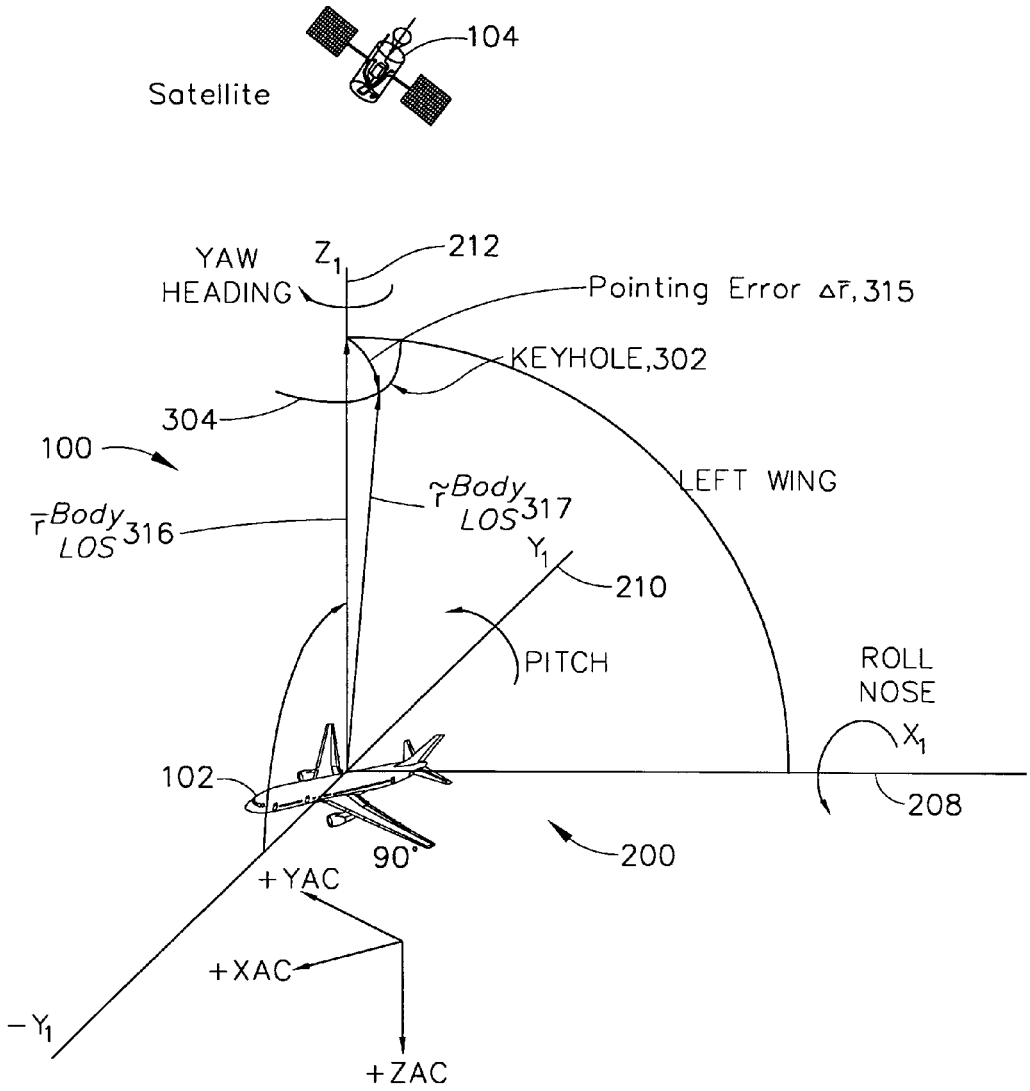
FIG. 3 is a geometrical diagram for a satellite communication system in accordance with one embodiment of the present invention.

FIGS. 2 and 3 show a body reference frame 200 and the relationship of its various axes to an antenna 202 for communication system 100 and to the body (e.g., platform 102) in relation to which body reference frame 200 is fixed. For example, the body may be platform 102, and platform 102 may be assumed to be an aircraft for purposes of the terminology used in FIG. 2. FIG. 2 also shows the relationship of the axes of body reference frame 200 to a set of gimbals axes.

Antenna 202 may have an antenna pointing vector 204 which generally represents the direction of maximum beam energy of RF radiation of antenna 202 and may also be considered as the RF line-of-sight of antenna 202. Antenna 202 may have a long a-b axis 206 and a short axis 207 perpendicular to long axis 206. The direction of antenna LOS pointing vector 204 may be controlled relative to axis 206 by electronic beam steering, e.g., shifting the relative phase of antenna elements of antenna 202. Operating the link of communication system 100 between platform 102 and satellite 104 requires aiming antenna pointing vector 204 in the direction of satellite 104, e.g., aligning pointing vector 204 with range pointing vector $\vec{r}_{LOS}^{ECEF}$ 116.

Although FIG. 2 schematically represents a gimbals having 3 axes, it is to be understood that FIG. 2 is a schematic diagram only and that antenna pointing function of at least one of the gimbals axes may be achieved, according to one embodiment, by electronically steering the beam of antenna 202 to change the direction of antenna pointing vector 204, while antenna pointing function of other gimbals axes may be achieved through the mechanical mounting of the antenna 202 to mechanical gimbals which change the direction of antenna pointing vector 204 by mechanically moving the antenna 202.

Body reference frame 200 may include an X-axis 208, having a positive direction in the direction of the nose of the aircraft, e.g., platform 102, and may be considered as an aircraft roll axis with a positive roll angle 209 moving the right wing down. The X-axis 208 may be used to measure the $r_1$ coordinate of $\vec{r}_{LOS}^{Body}$ 316 (see FIG. 3), the representation of normalized range pointing vector $\vec{r}_{LOS}^{ECEF}$ 116 with respect to body reference frame 200. Body reference frame 200 may include a Y-axis 210, having a positive direction in the direction of the left wing of the aircraft body and may be considered as an aircraft pitch axis with a positive pitch angle 211 moving the nose up. The Y-axis 210 may be used to measure the $r_2$ coordinate of range pointing vector $\vec{r}_{LOS}^{Body}$ 316 with respect to body reference frame 200. Body reference frame 200 may include a Z-axis 212, having a positive direction in the direction of the top of the aircraft body and may be considered as an aircraft yaw or heading axis with a positive yaw angle 213 turning the aircraft clockwise as viewed from the top. The Z-axis 212 may be used to measure the $r_3$ coordinate of range pointing vector $\vec{r}_{LOS}^{Body}$ 316 with respect to body reference frame 200.

A two-axis gimbals control system 201 may include a gimbals azimuth axis 222 and a gimbals elevation axis 220. The gimbals azimuth axis 222 may coincide with Z-axis 212, as shown in FIG. 2. In the example used to illustrate one embodiment, gimbals azimuth axis 220 may be a mechanical axis. An azimuth angle AZ 223 may have positive direction corresponding to that of positive yaw angle 213. The gimbals elevation axis 220 may be held perpendicular to gimbals azimuth axis 222 and may lie in the plane of X-axis 208 and Y-axis 210. For example, FIG. 2 shows gimbals elevation axis 220 in a position that coincides with Y-axis 210. In the example used to illustrate one embodiment, gimbals elevation axis 220 may be a mechanical axis. An elevation angle EL 221 may have positive direction corresponding to that of positive pitch angle 211. Antenna 202 may be mounted to gimbals elevation axis 220 so that the long axis 206 of antenna 202 is along gimbals elevation axis 220.

A cross-elevation axis 218 may be perpendicular to gimbals elevation axis 220 and may lie in the plane of X-axis 208 and Y-axis 210. For example, FIG. 2 shows cross-elevation axis 218 in a position that coincides with X-axis 208. In the example used to illustrate one embodiment, cross-elevation axis 218 may be a virtual axis provided by electronic steering of antenna pointing vector 204 rather than a mechanical gimbals axis. A cross-elevation angle XEL 219 may have positive direction corresponding to that of positive roll angle 209.

When range pointing vector $\vec{r}_{LOS}^{ECEF}$ 116 ($\vec{r}_{LOS}^{Body}$ 316) is not in the keyhole region 302 (see FIG. 3), the two-axis gimbals system using azimuth axis 222 and elevation axis 220 may be used to point RF antenna 202 from platform 102 in the direction of satellite 104, i.e., to command pointing vector 204 to align with range pointing vector $\vec{r}_{LOS}^{Body}$ 316, which is the representation of normalized range pointing vector $\vec{r}_{LOS}^{ECEF}$ 116 with respect to body reference frame 200. The commanded azimuth angle AZ 223 and elevation angle EL 221 may be computed by:

$$AZ = -\tan^{-1}\left(\frac{r_2}{r_1}\right); \quad EL = \tan^{-1}\left(\frac{r_3}{\sqrt{r_1^2 + r_2^2}}\right) \tag{2}$$

where $r_1$, $r_2$, and $r_3$ are the three coordinates, with respect to body frame 200 of $$\vec{r}_{LOS}^{Body} = \begin{bmatrix} r_1 \\ r_2 \\ r_3 \end{bmatrix} = [C_{LL}^{Body}][C_{ECEF}^{LL}]\vec{r}_{LOS}^{ECEF} \tag{3}$$

where $C_{LL}^{Body}$ is the aircraft body attitude with respect to a local level (LL) frame, and $C_{ECEF}^{LL}$ is the LL attitude with respect to the ECEF frame 106. For example, $C_{LL}^{Body}$ may be a three by three coordinate transformation matrix from an LL reference frame (e.g., a reference frame (not shown) centered at reference frame 200 but with the negative Z-axis pointing toward the center of mass of the planet) into the body reference frame 200, and $C_{ECEF}^{LL}$ may be a three by three coordinate transformation matrix from the ECEF reference frame 106 into the LL reference frame.

The following considerations apply, however, when range pointing vector $\vec{r}_{LOS}^{ECEF}$ 116 ($\vec{r}_{LOS}^{Body}$ 316) enters the keyhole region 302. The azimuth rate, d(AZ)/dt—e.g., the spinning velocity of the gimbals around azimuth axis 222—and the azimuth acceleration, $d^2(AZ)/dt^2$—e.g., spinning force, or torque, on the gimbals around azimuth axis 222—can be shown to be approximated as:

$$\begin{aligned} \frac{d(AZ)}{dt} &\approx -\left(\frac{r_1}{r_1^2 + r_2^2}\right)\dot{r}_2 = \frac{-r_1}{\sqrt{r_1^2 + r_2^2}}\frac{\sin(EL)}{\sqrt{r_1^2 + r_2^2}}\dot{\phi} \\ &\approx \cos(AZ)\tan(EL)\dot{\phi} \end{aligned} \tag{4}$$

and $$\frac{d^2(AZ)}{dt^2} \approx (\sin(AZ)\tan(EL))\dot{\phi}\dot{AZ} - (\cos(AZ)\tan(EL))\ddot{\phi} \tag{5}$$

where $\phi$ is the aircraft roll angle, e.g., roll angle 209. (Dot and double dot above a variable follow the standard mathematical notation for first and second time derivatives of the variable.) Hence, as the elevation angle EL 221 approaches 90 degrees, e.g., the keyhole region 302, the azimuth rate and azimuth acceleration "become infinite" (due to tan(EL) increasing without bound). Thus, antenna pointing cannot be precisely controlled when the antenna elevation is near 90 degrees, or in the keyhole region 302. It is noted that depending on the gimbals configuration the keyhole region 302 may occur at different elevation (EL 221) or azimuth (AZ 223) angles. For a given two-axis gimbaled antenna system, the keyhole region 302 may be defined as being where the corresponding elevation rate, or azimuth rate, approaches infinite at any operating gimbal angle range. The methods described in embodiments of this invention also apply to those cases where keyhole regions, as defined, exist.

To provide a first approach to precise control when the antenna line-of-sight (LOS), e.g., antenna pointing vector 204, enters the keyhole region 302, a third gimbals axis, e.g., cross-elevation axis 218, nested within the elevation axis 220, as shown in FIG. 2, may be considered. In this first approach, the azimuth gimbals axis 222 would be limited to its maximum azimuth acceleration and maximum azimuth rate. Thus, the above formulas for azimuth rate and azimuth acceleration may be used to find a value of EL, based on the physical properties of the particular gimbals system being used, that suggests what the appropriate keyhole region should be for the particular gimbals system and a keyhole region 302 may be defined for the particular gimbals system being used. For example, a keyhole region 302 for a typical gimbals system may include all elevation angles EL between 87 and 90 degrees, with the boundary or threshold 304 of the keyhole region 302 in this example being a locus of points at an elevation angle of 87 degrees as shown in FIG. 3. When the LOS pointing vector 204 enters the keyhole region, the elevation angle EL 221, and the cross-elevation angle XEL 219, may be computed in the first approach as follows:

$$EL = \text{cotan}^{-1}\left(\frac{r_1'}{r_3'}\right) \tag{6}$$

$$XEL = -\tan^{-1}\left(\frac{r_2'}{\sqrt{r_1'^2 + r_3'^2}}\right)$$

with $$\begin{bmatrix} r_1' \\ r_2' \\ r_3' \end{bmatrix} = \begin{bmatrix} \cos(AZ_m) & -\sin(AZ_m) & 0 \\ \sin(AZ_m) & \cos(AZ_m) & 0 \\ 0 & 0 & 1 \end{bmatrix} \begin{bmatrix} r_1 \\ r_2 \\ r_3 \end{bmatrix} \tag{7}$$

where $AZ_m$ is the measured azimuth angle AZ 223 which may be provided, for example, by a gimbal resolver, as known in the art.

Thus, in accordance with one embodiment using electronic beam steering to make cross-elevation XEL adjustments about cross-elevation axis 218, when the antenna line-of-sight (LOS), e.g., antenna pointing vector 204, enters the keyhole region 302, the azimuth angle AZ 223 and the elevation angle EL 221 may be commanded as follows:

$$AZ = -\tan^{-1}\left(\frac{r_2}{r_1}\right) \tag{8}$$

$$EL = \text{cotan}^{-1}\left(\frac{r_1'}{r_3'}\right).$$

A corresponding LOS pointing error vector $\Delta\vec{r}$ 315 (see FIG. 3) between range pointing vector $\vec{r}_{LOS}^{\,Body}$ 316 and keyhole coast-through pointing vector $\tilde{r}_{LOS}^{\,Body}$ 317 is then given by:

$$\Delta\vec{r} = \tilde{r}_{LOS}^{\,Body} - \vec{r}_{LOS}^{\,Body} \tag{9}$$

where:

$$\tilde{r}_{LOS}^{Body} = \begin{bmatrix} \cos(EL_m)\cos(AZ_m) \\ -\cos(EL_m)\sin(AZ_m) \\ \sin(AL_m) \end{bmatrix} \tag{10}$$

and where $AZ_m$ and $EL_m$ are measured values for azimuth angle AZ 223 and elevation angle EL 221 and may be measured, for example, by gimbals resolvers, as known in the art.

To derive the required cross-elevation and cross-azimuth electronically steered angles, xEL 330 and xAZ 340 (see FIG. 2), for canceling the LOS pointing error vector $\Delta\vec{r}$ 315, we first define the following parameters:

$$\begin{bmatrix} r_1'' \\ r_2'' \\ r_3'' \end{bmatrix} = \begin{bmatrix} \cos(EL_m) & 0 & \sin(EL_m) \\ 0 & 1 & 0 \\ -\sin(EL_m) & 0 & \cos(EL_m) \end{bmatrix} \begin{bmatrix} r_1' \\ r_2' \\ r_3' \end{bmatrix} \tag{11}$$

and then solve the following equations for xEL 330 and xAZ 340:

$$\begin{bmatrix} 1 \\ 0 \\ 0 \end{bmatrix} = \begin{bmatrix} \cos(xAZ) & 0 & \sin(xAZ) \\ 0 & 1 & 0 \\ -\sin(xAZ) & 0 & \cos(xAZ) \end{bmatrix} \begin{bmatrix} \cos(xEL) & -\sin(xEL) & 0 \\ \sin(xEL) & \cos(xEL) & 0 \\ 0 & 0 & 1 \end{bmatrix} \begin{bmatrix} r_1'' \\ r_2'' \\ r_3'' \end{bmatrix} \tag{12}$$

which gives:

$$xEL = -\tan^{-1}\left(\frac{r_2''}{r_1''}\right) \tag{13}$$

$$xAZ = \tan^{-1}\left(\frac{r_3''}{\sqrt{(r_1'')^2 + (r_2'')^2}}\right).$$

The angles xEL 330 and xAZ 340 may then be used to electronically steer the beam of antenna 202 to correct the antenna pointing, aligning antenna LOS pointing vector 204 with range pointing vector $\vec{r}_{LOS}^{\,Body}$ 316 (range pointing vector $\vec{r}_{LOS}^{\,ECEF}$ 116).

Figure 4:
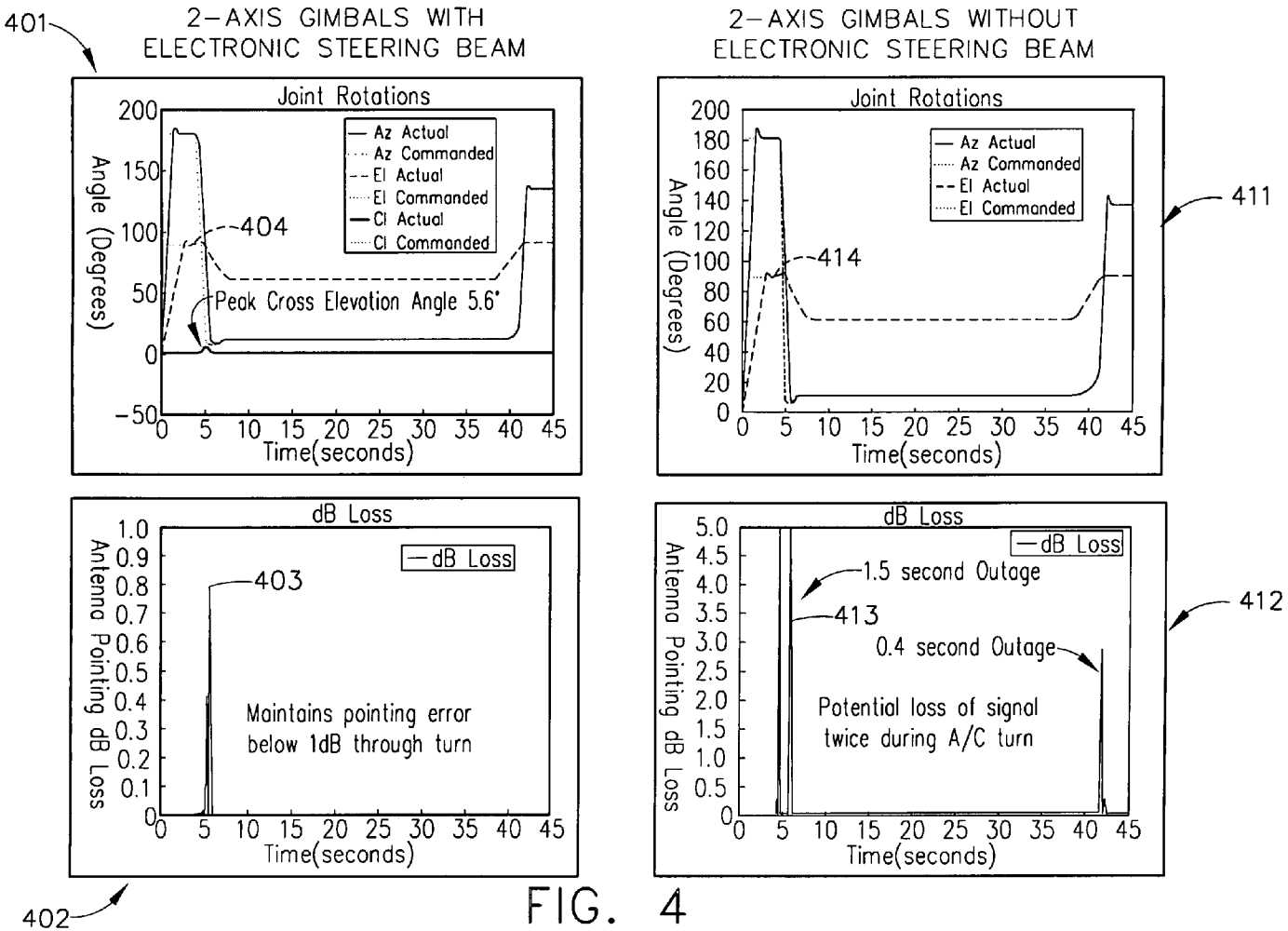
FIG. 4 is a set of four graphs comparing prior art antenna pointing performance with that of one embodiment of the present invention.

FIG. 4 shows graphs for a set of simulation results for a two-axis gimbaled system with—graphs 401, 402- and without—graphs 411, 412—the electronically steered beams for antenna LOS in the keyhole region. Using one embodiment of the present invention—see graphs 401, 402—the communication link between platform 102 and satellite 104 remains operative even when the LOS pointing vector 204 enters the keyhole region 302. For example, maximum antenna pointing error loss 403 remains less than 1 decibel (dB) when elevation angle EL 221 is in the keyhole region at point 404 on graph 401. On the other hand, as shown on graphs 411 and 412, the communication link between platform 102 and satellite 104 can be temporarily lost (antenna pointing error loss 413 exceeds 1 dB) for a two-axis gimbaled system without the electronically steered beam when its LOS enters the keyhole region at point 414 on graph 411.

Figure 5:
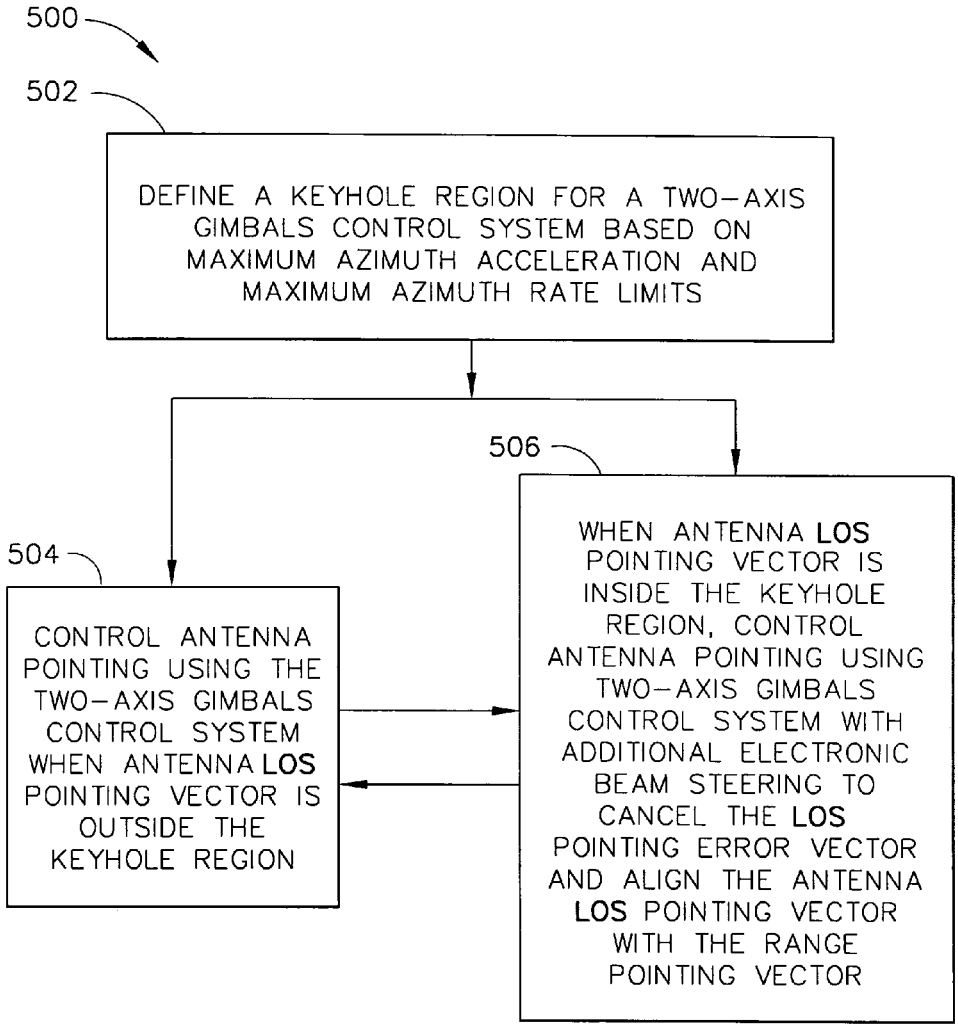
FIG. 5 is a flow chart of a method for communication system antenna pointing according to one embodiment of the present invention.

A method 500 for communication system antenna pointing is illustrated in FIG. 5. At step 502, a keyhole region 302 is defined for a two-axis gimbals control system 201. At step 504, antenna pointing is controlled using two-axis gimbals control system 201 when LOS pointing vector 204 is outside keyhole region 302. At step 506, when LOS pointing vector 204 is inside keyhole region 302, antenna pointing is controlled using two-axis gimbals control system 201 with additional electronic beam steering to provide electronically steered angles xEL 330 and xAZ 340, calculated using Equation (13), for example, for canceling the LOS pointing error vector $\Delta\vec{r}$ 315 and aligning antenna LOS pointing vector 204 with range pointing vector $\vec{r}_{LOS}^{\,Body}$ 316 (=range pointing vector $\vec{r}_{LOS}^{\,ECEF}$ 116). The method may alternate between step 504 and step 506 depending on whether the LOS pointing vector 204 is inside keyhole region 302 or outside keyhole region 302.

It should be understood, of course, that the foregoing relates to exemplary embodiments of the invention and that modifications may be made without departing from the spirit and scope of the invention as set forth in the following claims.

I claim:

1. A communication system comprising:

a two-axis gimbals control system adapted to adjust an antenna pointing direction relative to a gimbals azimuth axis and a gimbals elevation axis; and an antenna mounted to the two-axis gimbals control system along the gimbals elevation axis, wherein the antenna is adapted to provide a third axis of control of the antenna pointing direction by generating an electronically steered beam, at electronically steered angles that are calculated based on azimuth angles and elevation angles commanded to the two-axis gimbals control system, and to adjust the antenna pointing direction relative to a cross-elevation axis that is perpendicular to the gimbals elevation axis, and wherein the antenna is adapted to adjust the antenna pointing direction using the two-axis gimbals control system when the antenna pointing direction is outside of a keyhole regions and wherein the antenna is adapted to perform electronic beam steering to adjust the antenna pointing direction when an elevation angle is within a keyhole region.

2. The communication system of claim 1, wherein the two-axis gimbals control system provides measured values for azimuth angle and elevation angle from which is computed an LOS pointing error vector and cross-elevation and cross-azimuth electronically steered angles for canceling the LOS pointing error vector.

3. The communication system of claim 1, further comprising a moving platform that carries the two-axis gimbals control system.

4. The communication system of claim 1, further comprising a satellite wherein the antenna pointing direction is steered toward a satellite.

5. A communication system comprising:

a two-axis gimbals control system having a gimbals azimuth axis and a gimbals elevation axis;

an antenna mounted to the two-axis gimbals control system along the elevation axis, wherein the antenna generates an electronically steered beam that adjusts the antenna pointing direction relative to a cross-elevation axis that is perpendicular to the gimbals elevation axis; and a satellite wherein measured values for azimuth angle and elevation angle from the two-axis gimbals control system and a satellite range pointing vector relative to an Earth-centered, Earth-fixed frame are used to compute an LOS pointing error vector, the LOS pointing error vector is used to compute cross-elevation and cross-azimuth electronically steered angles for canceling the LOS pointing error vector, and cross-elevation and cross-azimuth electronically steered angles are used to adjust the antenna pointing direction to align an antenna LOS pointing vector with the satellite range pointing vector.

6. A communication system comprising:

a two-axis gimbals control system having a gimbals azimuth axis and a gimbals elevation axis; and an antenna mounted to the two-axis gimbals control system along the elevation axis, wherein the antenna generates an electronically steered beam that adjusts the antenna pointing direction relative to a cross-elevation axis that is perpendicular to the gimbals elevation axis, wherein a range pointing vector has coordinates $r_1$, $r_2$, $r_3$, the two-axis gimbals control system provides a measured value $AZ_m$ for azimuth angle and a measured value $EL_m$ for elevation angle, and the two-axis gimbals system is commanded with an azimuth angle AZ and elevation angle EL, wherein $$AZ = -\tan^{-1}\left(\frac{r_2}{r_1}\right) \quad EL = \operatorname{cotan}^{-1}\left(\frac{r_1'}{r_3'}\right) \quad \text{and} \quad \begin{bmatrix} r_1' \\ r_2' \\ r_3' \end{bmatrix} = \begin{bmatrix} \cos(AZ_m) & -\sin(AZ_m) & 0 \\ \sin(AZ_m) & \cos(AZ_m) & 0 \\ 0 & 0 & 1 \end{bmatrix} \begin{bmatrix} r_1 \\ r_2 \\ r_3 \end{bmatrix}.$$

7. The communication system of claim 6, wherein:

a cross-elevation electronically steered angle xEL and a cross-azimuth electronically steered angle xAZ are used to adjust the antenna pointing direction to align an antenna LOS pointing vector with the range pointing vector;

$$xEL = -\tan^{-1}\left(\frac{r_2''}{r_1''}\right)$$

$$xAZ = \tan^{-1}\left(\frac{r_3''}{\sqrt{(r_1'')^2 + (r_2'')^2}}\right); \text{ and}$$

$$\begin{bmatrix} r_1'' \\ r_2'' \\ r_3'' \end{bmatrix} = \begin{bmatrix} \cos(EL_m) & 0 & \sin(EL_m) \\ 0 & 1 & 0 \\ -\sin(EL_m) & 0 & \cos(EL_m) \end{bmatrix} \begin{bmatrix} r_1' \\ r_2' \\ r_3' \end{bmatrix}.$$

8. The communication system of claim 7, further comprising:

a moving platform that carries the two-axis gimbals control system and has a body reference frame; and a satellite wherein the range pointing vector is the normalized range pointing vector of the satellite with respect to the body reference frame.

9. A method for antenna pointing comprising the steps of:

controlling antenna pointing using a two-axis gimbals control system when an antenna LOS pointing vector is outside a keyhole region;

controlling antenna pointing using the two-axis gimbals control system with additional electronic beam steering using electronically steered angles when the antenna LOS pointing vector is inside the keyhole region;

providing a measured value $AZ_m$ for azimuth angle and a measured value $EL_m$ for elevation angle from the two-axis gimbals control system; and computing an electronically steered cross-azimuth angle xAZ and an electronically steered cross-elevation angle xEL wherein $$xEL = -\tan^{-1}\left(\frac{r_2''}{r_1''}\right)$$

$$xAZ = \tan^{-1}\left(\frac{r_3''}{\sqrt{(r_1'')^2 + (r_2'')^2}}\right);$$

$$\begin{bmatrix} r_1'' \\ r_2'' \\ r_3'' \end{bmatrix} = \begin{bmatrix} \cos(EL_m) & 0 & \sin(EL_m) \\ 0 & 1 & 0 \\ -\sin(EL_m) & 0 & \cos(EL_m) \end{bmatrix} \begin{bmatrix} r_1' \\ r_2' \\ r_3' \end{bmatrix}; \text{ and}$$

$$\begin{bmatrix} r_1' \\ r_2' \\ r_3' \end{bmatrix} = \begin{bmatrix} \cos(AZ_m) & -\sin(AZ_m) & 0 \\ \sin(AZ_m) & \cos(AZ_m) & 0 \\ 0 & 0 & 1 \end{bmatrix} \begin{bmatrix} r_1 \\ r_2 \\ r_3 \end{bmatrix},$$

wherein $r_1$, $r_2$, and $r_3$ are the coordinates of a range pointing vector for pointing the antenna.

10. A method for communication system antenna pointing from a moving platform, comprising the steps of:

commanding an azimuth angle and an elevation angle to a two-axis gimbals control system on the moving platform and having a gimbals azimuth axis and a gimbals elevation axis;

computing a cross-azimuth angle and cross-elevation angle for an antenna mounted to the two-axis gimbals control system along the elevation axis; and adjusting the antenna pointing direction electronically relative to a cross-elevation axis that is perpendicular to the gimbals elevation axis, using the cross-azimuth angle and cross-elevation angle.

11. The method of claim 10, further comprising steps of:

defining a keyhole region for the two-axis gimbals control system based on a threshold elevation angle;

adjusting antenna pointing using the two-axis gimbals control system when the antenna pointing direction is outside the keyhole region; and adjusting antenna pointing using electronic beam steering when the antenna pointing direction is inside the keyhole region.

12. The method of claim 10, wherein the commanding step further comprises steps of:

computing coordinates $r_1$, $r_2$, $r_3$ in a body reference frame of the moving platform for a normalized range pointing vector of a satellite in an Earth-centered, Earth-fixed frame;

providing a measured value $AZ_m$ for azimuth angle and a measured value $EL_m$ for elevation angle from the two-axis gimbals control system; and commanding the two-axis gimbals system with the azimuth angle AZ and the elevation angle EL, wherein:

$$AZ = -\tan^{-1}\left(\frac{r_2}{r_1}\right) \quad EL = \text{cotan}^{-1}\left(\frac{r_1'}{r_3'}\right) \quad \text{and} \quad \begin{bmatrix} r_1' \\ r_2' \\ r_3' \end{bmatrix} = \begin{bmatrix} \cos(AZ_m) & -\sin(AZ_m) & 0 \\ \sin(AZ_m) & \cos(AZ_m) & 0 \\ 0 & 0 & 1 \end{bmatrix} \begin{bmatrix} r_1 \\ r_2 \\ r_3 \end{bmatrix}.$$

13. The method of claim 12, wherein the computing step of claim 10 further comprises steps of:

$$\text{computing} \begin{bmatrix} r_1'' \\ r_2'' \\ r_3'' \end{bmatrix} = \begin{bmatrix} \cos(EL_m) & 0 & \sin(EL_m) \\ 0 & 1 & 0 \\ -\sin(EL_m) & 0 & \cos(EL_m) \end{bmatrix} \begin{bmatrix} r_1' \\ r_2' \\ r_3' \end{bmatrix}; \text{ and}$$

computing the cross-azimuth angle as cross-azimuth electronically steered angle xAZ and cross-elevation angle as cross-elevation electronically steered angle xEL, wherein:

$$xEL = -\tan^{-1}\left(\frac{r_2''}{r_1''}\right)$$
$$xAZ = \tan^{-1}\left(\frac{r_3''}{\sqrt{(r_1'')^2 + (r_2'')^2}}\right).$$

14. The method of claim 13, wherein the adjusting step of claim 10 further comprises:

adjusting the antenna pointing direction using the cross-elevation electronically steered angle xEL and the cross-azimuth electronically steered angle xAZ to align an antenna LOS pointing vector with the normalized range pointing vector having coordinates $r_1$, $r_2$, $r_3$ in the body reference frame of the moving platform.

* * * * *